US010294834B2

(12) United States Patent
Zurface et al.

(10) Patent No.: US 10,294,834 B2
(45) Date of Patent: May 21, 2019

(54) CYLINDER DEACTIVATION DEACTIVATING ROLLER FINGER FOLLOWER HAVING IMPROVED PACKAGING

(71) Applicant: Eaton Corporation, Cleveland, OH (US)

(72) Inventors: Austin Zurface, Hastings, MI (US); James Edward McCarthy, Jr., Kalamazoo, MI (US); Andrei Radulescu, Marshall, MI (US)

(73) Assignee: Eaton Corporation, Cleveland, OH (US)

( * ) Notice: Subject to any disclaimer, the term of this patent is extended or adjusted under 35 U.S.C. 154(b) by 57 days.

(21) Appl. No.: 15/342,763

(22) Filed: Nov. 3, 2016

(65) Prior Publication Data

US 2017/0074128 A1 Mar. 16, 2017

Related U.S. Application Data

(63) Continuation of application No. PCT/US2015/029361, filed on May 6, 2015.

(Continued)

(51) Int. Cl.
*F01L 13/00* (2006.01)
*F01L 1/18* (2006.01)

(Continued)

(52) U.S. Cl.
CPC ..... *F01L 13/0005* (2013.01); *F01L 1/053* (2013.01); *F01L 1/185* (2013.01); *F01L 1/2416* (2013.01);

(Continued)

(58) Field of Classification Search
CPC ..... F01L 13/0005; F01L 1/053; F01L 1/185; F01L 1/2416; F01L 1/2405
See application file for complete search history.

(56) References Cited

U.S. PATENT DOCUMENTS 8,215,275 B2 * 7/2012 Church ..... F01L 1/185 123/90.16
8,251,032 B2 8/2012 Manther (Continued)

FOREIGN PATENT DOCUMENTS

| | | | |
|---|---|---|---|
| DE | 102014221812 | A1 | 4/2016 |
| EP | 2711510 | A1 | 3/2014 |
| WO | 2013067506 | A1 | 5/2013 |

OTHER PUBLICATIONS

International Search Report and Written Opinion for International Application No. PCT/US2015/029361 dated Jul. 28, 2015, 13 pages.

(Continued)

*Primary Examiner* — Thomas C Diaz
(74) *Attorney, Agent, or Firm* — RMCK Law Group PLC

(57) ABSTRACT

A switching rocker arm assembly constructed in accordance to one example of the present disclosure can include an outer arm, an inner arm, a pivot axle, a bearing axle, a first torsional bearing axle spring and a second torsional bearing axle spring. The outer arm can have a first outer side arm and a second outer side arm. The outer arm can further include first and second torsional spring mounts. The inner arm can be disposed between the first and second outer side arms. The pivot axle can support the inner and outer arm for relative pivotal movement therearound. The bearing axle can support a bearing. The first torsional bearing axle spring can be mounted around the first torsional spring mount and (Continued)

have a first end engaged to the bearing axle and a second end engaged to the outer arm. The first end extends inboard relative to the second end.

18 Claims, 14 Drawing Sheets

Related U.S. Application Data

(60) Provisional application No. 61/989,499, filed on May 6, 2014, provisional application No. 61/990,067, filed on May 7, 2014, provisional application No. 62/074,016, filed on Nov. 1, 2014, provisional application No. 62/074,547, filed on Nov. 3, 2014, provisional application No. 61/989,507, filed on May 6, 2014.

(51) Int. Cl.
*F01L 1/053* (2006.01)
*F01L 1/24* (2006.01)

(52) U.S. Cl.
CPC ..... *F01L 1/2405* (2013.01); *F01L 13/0036* (2013.01); *F01L 2001/186* (2013.01); *F01L 2001/2444* (2013.01); *F01L 2013/001* (2013.01); *F01L 2105/00* (2013.01)

(56) References Cited

U.S. PATENT DOCUMENTS

| | | | | |
|---|---|---|---|---|
| 8,627,796 | B2 * | 1/2014 | Harman | F01L 1/185 123/90.16 |
| 8,733,311 | B2 * | 5/2014 | Manther | F01L 1/185 123/90.16 |
| 2013/0000582 | A1 | 1/2013 | Church | |
| 2013/0186358 | A1 | 7/2013 | Manther et al. | |

OTHER PUBLICATIONS

European Search Report for EP Application No. 15789388.4 dated Jan. 12, 2018, 6 pages.

* cited by examiner

CYLINDER DEACTIVATION DEACTIVATING ROLLER FINGER FOLLOWER HAVING IMPROVED PACKAGING

CROSS-REFERENCE TO RELATED APPLICATIONS

This application is a continuation of International Application No. PCT/US2015/029361 filed on May 6, 2015 which claims the benefit of U.S. Patent Application No. 61/989,499 filed on May 6, 2014; U.S. Patent Application No. 61/990,067 filed on May 7, 2014; U.S. Patent Application No. 62/074,016 filed on Nov. 1, 2014; U.S. Patent Application 62/074,547 filed on Nov. 3, 2014; and U.S. Patent Application No. 61/989,507 filed on May 6, 2014. The disclosures of the above applications are incorporated herein by reference.

FIELD

The present disclosure relates generally to switching roller finger followers or rocker arms in internal combustion engines.

BACKGROUND

Variable valve actuation (VVA) technologies have been introduced and documented. One VVA device may be a variable valve lift (VVL) system, a cylinder deactivation (CDA) system such as that described in commonly owned U.S. Pat. No. 8,215,275 entitled "Single Lobe Deactivating Rocker Arm" hereby incorporated by reference in its entirety, or other valve actuation systems. Such mechanisms are developed to improve performance, fuel economy, and/or reduce emissions of the engine. Several types of the VVA rocker arm assemblies include an inner rocker arm within an outer rocker arm that are biased together with torsion springs.

Switching rocker arms allow for control of valve actuation by alternating between latched and unlatched states. A latch, when in a latched position causes both the inner and outer rocker arms to move as a single unit. When unlatched, the rocker arms are allowed to move independent of each other. In some circumstances, these arms can engage different cam lobes, such as low-lift lobes, high-lift lobes, and no-lift lobes. Mechanisms are required for switching rocker arm modes in a manner suited for operation of internal combustion engines.

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

A switching rocker arm assembly constructed in accordance to one example of the present disclosure can include an outer arm, an inner arm, a pivot axle, a bearing axle, a first torsional bearing axle spring and a second torsional bearing axle spring. The outer arm can have a first outer side arm and a second outer side arm. The outer arm can further include first and second torsional spring mounts. The inner arm can be disposed between the first and second outer side arms.

The pivot axle can support the inner and outer arm for relative pivotal movement therearound. The bearing axle can support a bearing. The first torsional bearing axle spring can be mounted around the first torsional spring mount and have a first end engaged to the bearing axle and a second end engaged to the outer arm. The first end can extend inboard relative to the second end. The second torsional bearing axle spring can be mounted around the second torsional spring mount and have a first end engaged to the bearing axle and a second end engaged to the outer arm. The first end of the second torsional bearing axle spring can extend inboard relative to the second end of the second torsional bearing spring.

According to additional features, the switching rocker arm can further include a roller follower mounted between the first inner side arm and the second inner side arm on the bearing axle. The first end of the first torsional bearing axle spring is nestingly received in a first groove formed in the bearing axle. The first end of the second torsional bearing axle spring is nestingly received in a second groove formed in the bearing axle. The second end of the first torsional bearing axle spring engages a first tang extending from the outer arm. The second end of the second torsional bearing axle spring engages a second tang extending from the outer arm. The switching rocker arm can further include an elephant foot (e-foot). The e-foot can be assembled between a central axle body of the pivot axle and a valve. Rotation of the pivot axle causes the e-foot to move relative to the valve.

According to additional features, the first and second tangs can extend outboard of the first and second torsional bearing axle springs. The switching rocker arm assembly can further include a latch that selectively secures the inner arm relative to the outer arm thereby selectively permitting lost motion movement of the inner arm relative to the outer arm about the pivot axle. A latch spring can be disposed within a collective pocket defined between (i) a first recess in the latch and (ii) a second recess in a latch retainer. The collective pocket can support a latch spring having a length of 8.2 mm.

A switching rocker arm assembly constructed in accordance to another example of the present disclosure can include an outer arm, an inner arm, a pivot axle, a bearing axle, a first torsional bearing axle spring and a second torsional bearing axle spring. The outer arm can have a first outer side arm and a second outer side arm. The outer arm can further include first and second torsional spring mounts. The inner arm can be disposed between the first and second outer side arms. The pivot axle can support the inner and outer arm for relative pivotal movement therearound. The bearing axle can support a bearing. The first torsional bearing axle spring can be mounted around the first torsional spring mount and have a first end engaged to the bearing axle and a second end engaged to the outer arm. The first end can extend inboard relative to the second end. The second end can have (i) a first portion that extends toward the outer arm in a direction transverse to the first end and (ii) a second portion including a terminal tip that extends in a direction parallel to the first end.

The second torsional bearing axle spring can be mounted around the second torsional spring mount and have a first end engaged to the bearing axle and a second end engaged to the outer arm. The first end of the second torsional bearing axle spring can extend inboard relative to the second end of the second torsional bearing spring. The second end of the second torsional bearing axle spring can have (i) a first portion that extends toward the outer arm in a direction transverse to the first end of the second torsional bearing axle spring and (ii) a second portion including a terminal tip that extends in a direction parallel to the first end of the second torsional bearing axle spring.

BRIEF DESCRIPTION OF THE DRAWINGS

The present disclosure will become more fully understood from the detailed description and the accompanying drawings, wherein.

DETAILED DESCRIPTION

Figure 1:
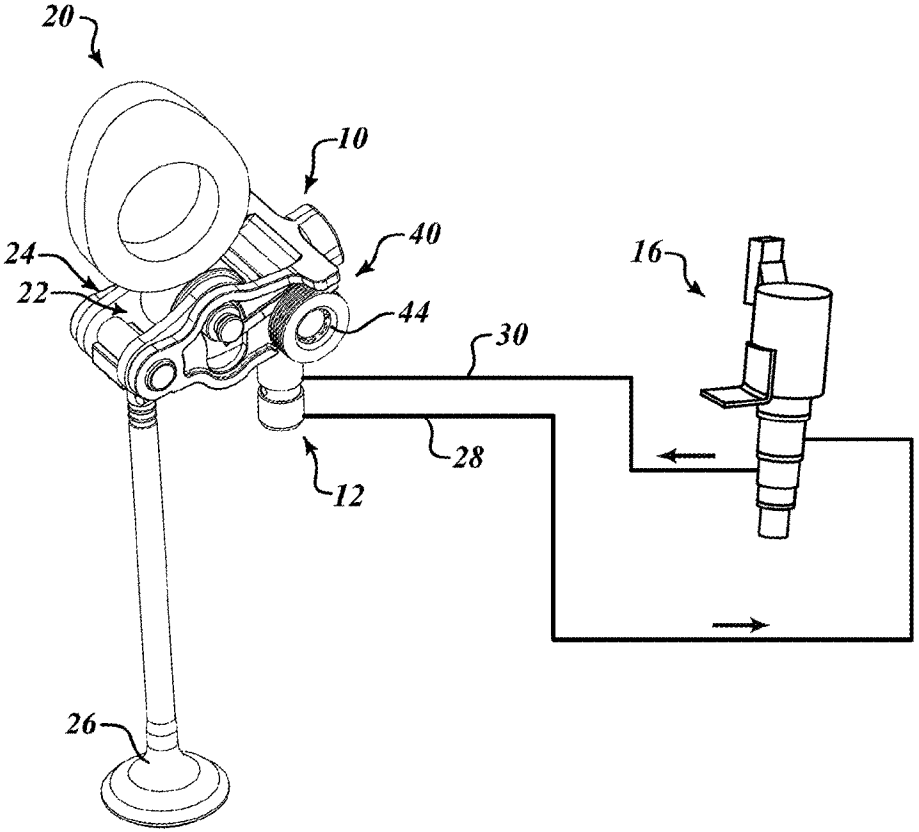
FIG. 1 is a front perspective view of an exemplary switching rocker arm constructed in accordance to one example of the present disclosure, the switching rocker arm shown with an exemplary valve and lash adjuster.
Figure 2:
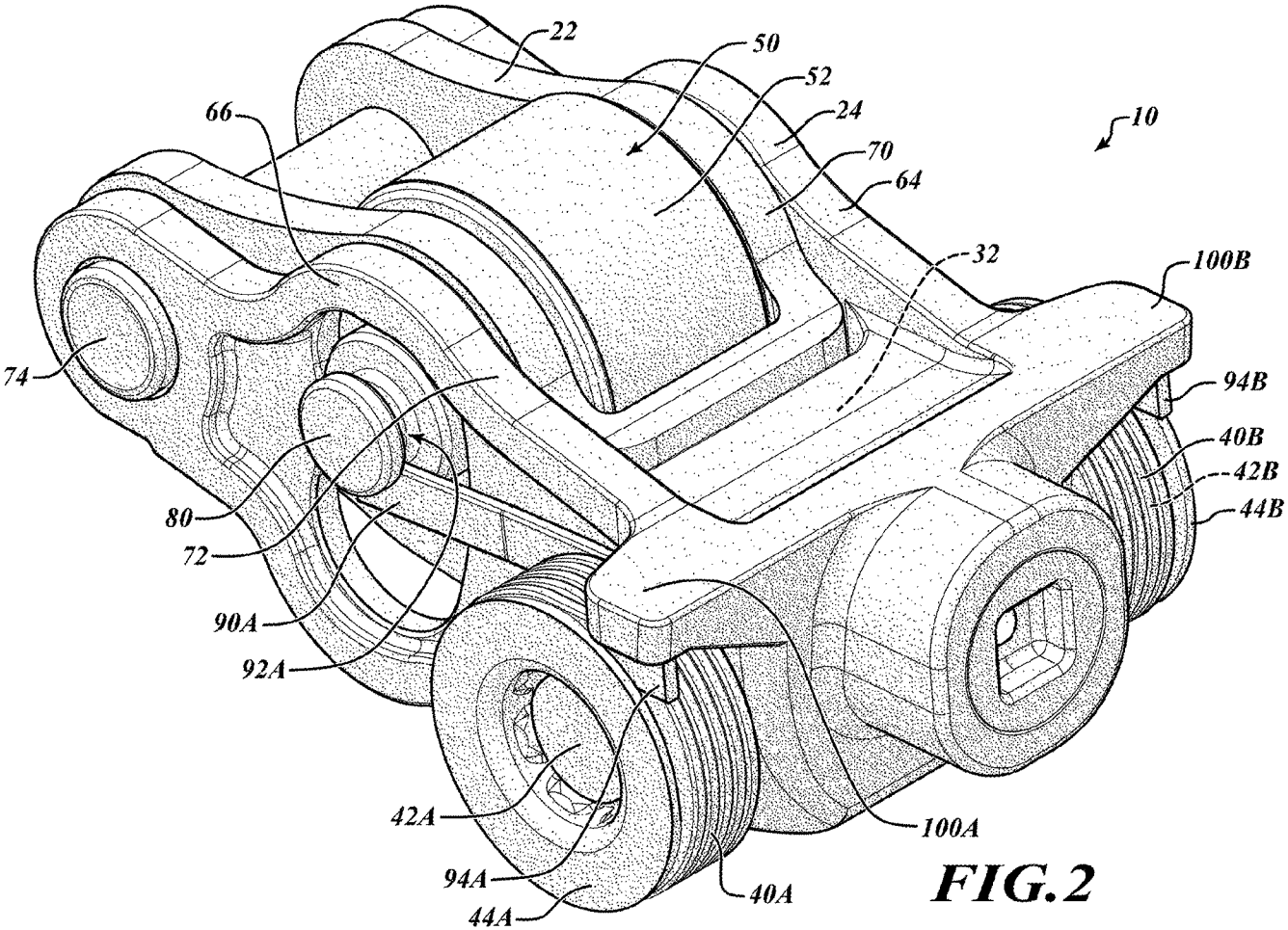
FIG. 2 is a top perspective view of the switching rocker arm of FIG. 1.
Figure 3:
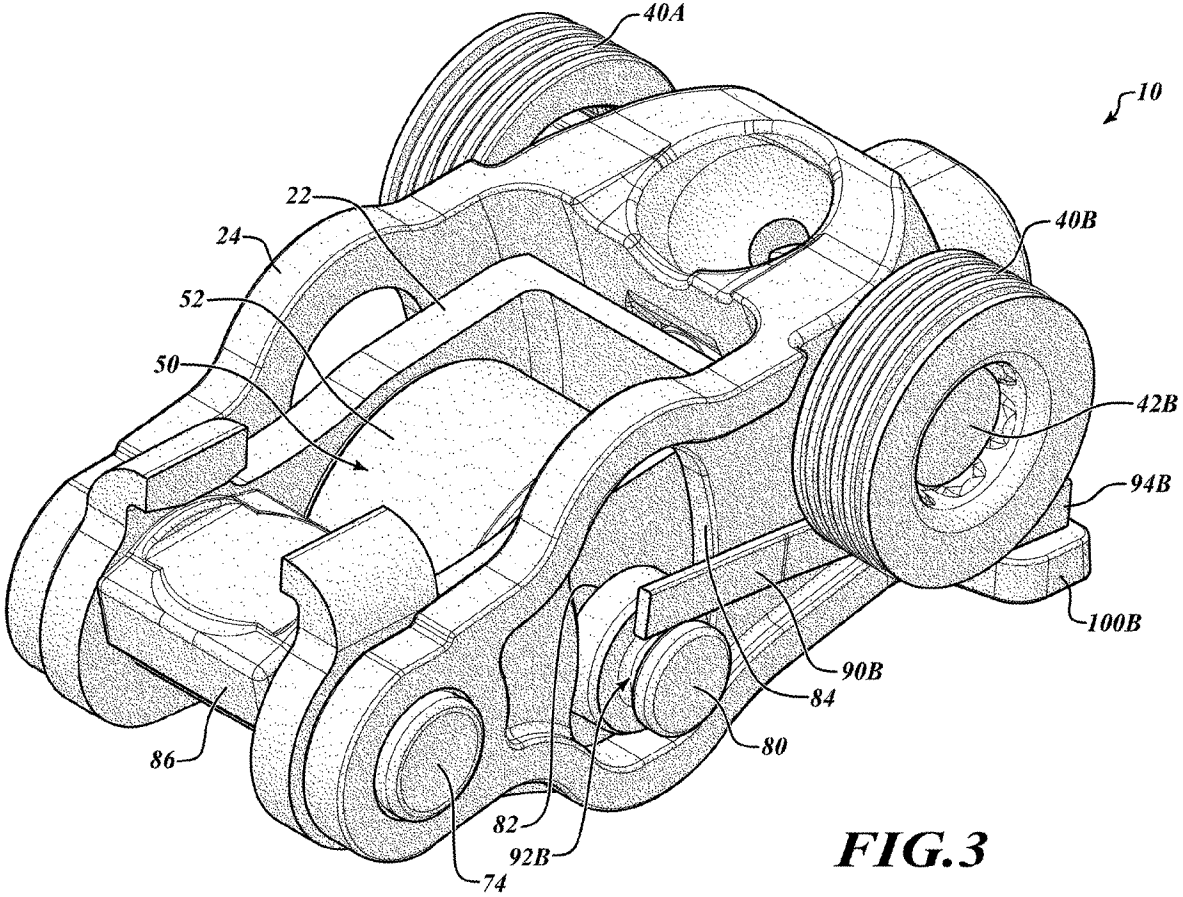
FIG. 3 is a bottom perspective view of the switching rocker arm of FIG. 2.

With initial reference to FIGS. 1-5, an exemplary switching rocker arm constructed in accordance to one example of prior art is shown and generally identified at reference 10. The switching rocker arm assembly 10 can be a compact cam-driven single-lobe cylinder deactivation (CDA-1L) switching rocker arm installed on a piston-driven internal combustion engine, and actuated with the combination of a duel-feed hydraulic lash adjusters (DFHLA) 12 that receive oil from oil control valves ("OCV") 16. The switching rocker arm assembly 10 can be engaged by a single lobe cam 20. The switching rocker arm 10 can include an inner arm 22, an outer arm 24. The default configuration is in the normal-lift (latched) position where the inner arm 22 and the outer arm 24 are locked together, causing an engine valve 26 to open and allowing the cylinder to operate as it would in a standard valvetrain. The DFHLA 12 has two oil ports. A lower oil port 28 provides lash compensation and is fed engine oil similar to a standard HLA. An upper oil port 30, referred as the switching pressure port, provides the conduit between controlled oil pressure from the OCV 16 and a latch 32. When the latch 32 is engaged, the inner arm 22 and the outer arm 24 operate together like a standard rocker arm to open the engine valve 26. In the no-lift (unlatched) position, the inner arm 22 and the outer arm 24 can move independently to enable cylinder deactivation.

A pair of lost motion torsion springs 40A and 40B are incorporated to bias the position of the inner arm 22 so that it always maintains continuous contact with the camshaft lobe 20. The torsion springs 40A and 40B are secured to torsional spring mounts 42A and 42B, respectively located on the outer arm 24 by spring retainers 44A, 44B. The spring retainers 44A, 44B retain the torsion springs 40A, 40B laterally. The lost motion torsion springs 40A, 40B require a higher preload than designs that use multiple lobes to facilitate continuous contact between the camshaft lobe 20 and an inner arm bearing 50 having a roller follower 52.

The outer arm 24 can have a first outer side arm 64 and a second outer side arm 66. The inner arm 22 can be disposed between the first outer side arm 64 and the second outer side arm 66. The inner arm 22 can have a first inner side arm 70 and a second inner side arm 72. The inner arm 22 and the outer arm 24 are both mounted to a pivot axle 74. The pivot axle 74 can be located adjacent to a first end of the rocker arm assembly 10, which secures the inner arm 22 to the outer arm 24 while also allowing a rotational degree of freedom pivoting about the pivot axle 74 when the rocker arm assembly 10 is in a deactivated state.

The bearing 50 and roller follower 52 are mounted between the first inner side arm 70 and the second inner side arm 72 on a bearing axle 80 that, during normal operation of the rocker arm assembly 10 serves to transfer energy from the rotating cam 20 to the rocker arm assembly 10. The bearing axle 80 is biased upwardly by the bearing axle springs 40A, 40B. Mechanical lash can be set mechanically with a valve tip cap (not specifically shown). It will be appreciated that a plurality of valve tip caps may be provided having different geometries. A suitable valve tip cap can be assembled between an elephant foot (e-foot) 86 (FIG. 3) and the engine valve 26 to take up the variance on the rocker arm assembly 10 between the engine valve 26, the cam 20 and the DFHLA 12. The e-foot 86 is assembled between the central axle body of the pivot axle 74 and the valve 26, wherein rotation of the pivot axle 74 can cause the e-foot 86 to move relative to the valve 26. The bearing axle 80 is mounted to the inner arm 22 in bearing axle apertures 82 defined in the inner arm 22. The bearing axle 80 extends through bearing axle slots 84 defined in the outer arm 24.

With particular reference now to FIG. 1, additional features of the rocker arm assembly 10 will be described. The rocker arm assembly 10 incorporates a torsion spring configuration that is particularly favorable for packaging constraints seen in some engine configurations. In this regard, both of the torsion springs 40A, 40B have a first or inboard end 90A, 90B that engages the bearing axle 80 at a bearing axle groove 92A, 92B. Both of the torsion springs 40A, 40B also have a second or outboard end 94A, 94B that engages a tang 100A, 100B extending from the outer arm 24.

Figure 4:
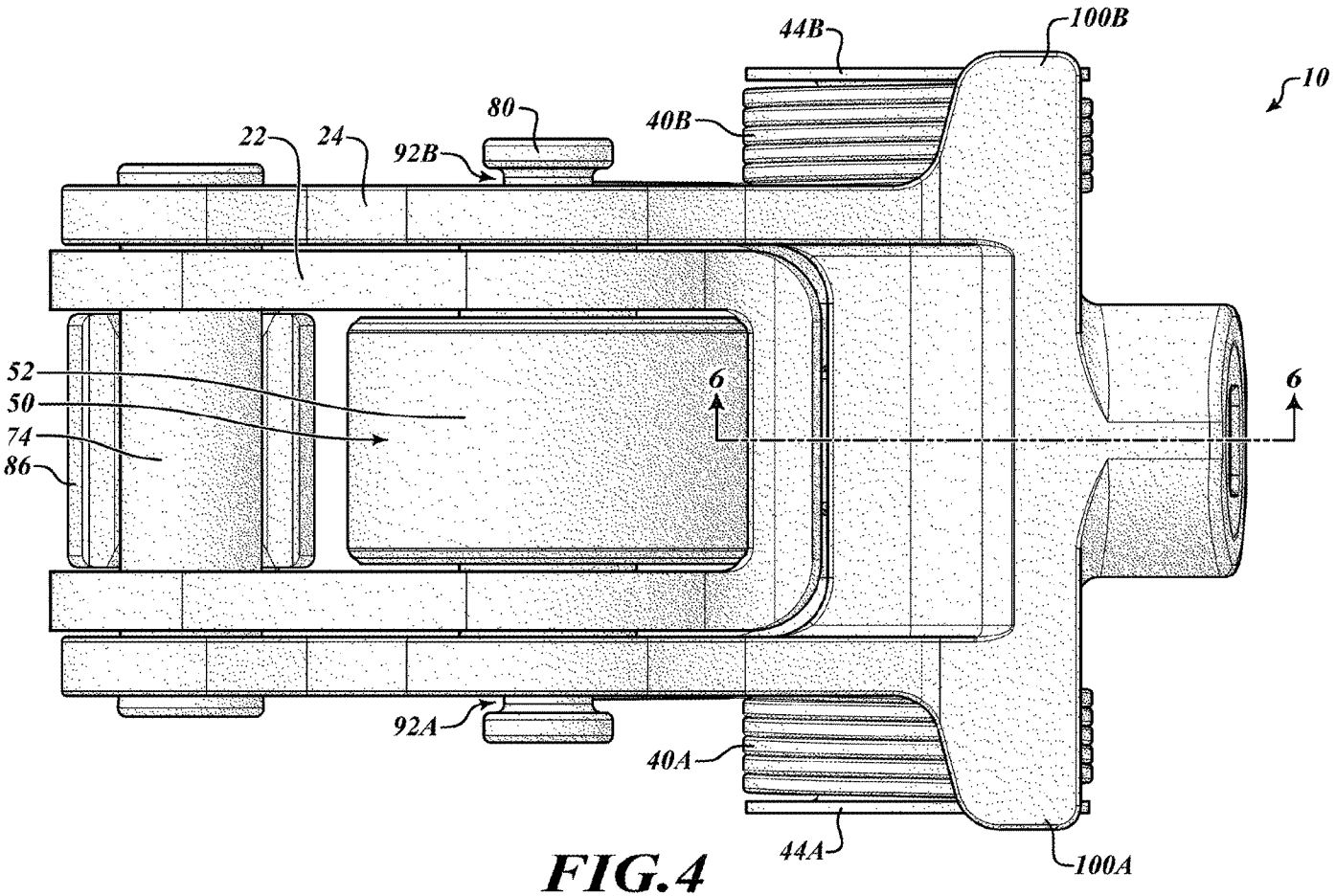
FIG. 4 is a top view of the switching rocker arm of FIG. 2.
Figure 5:
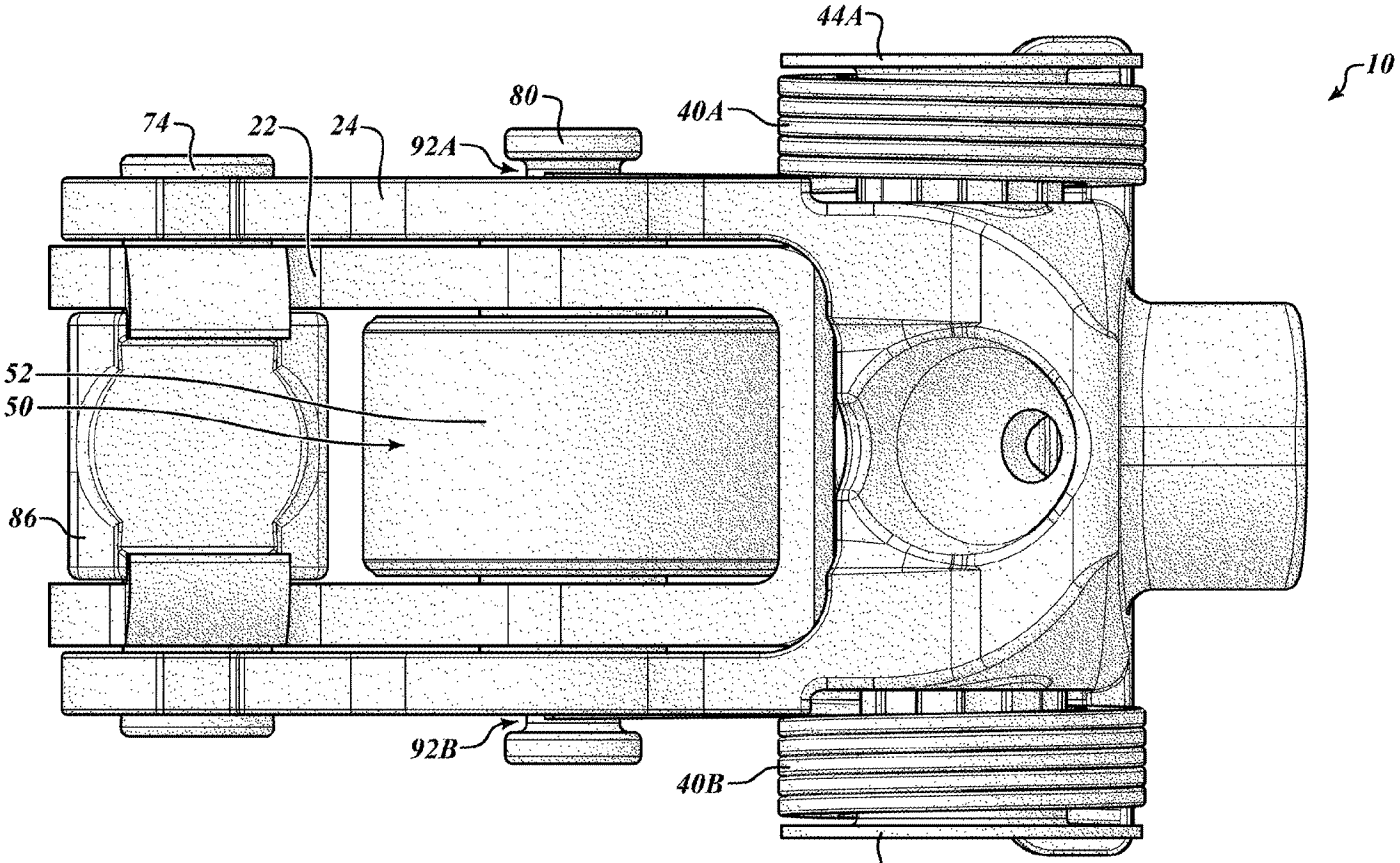
FIG. 5 is a bottom view of the switching rocker arm of FIG. 2.

Notably, the tangs 100A, 100B extend outboard of the torsions springs 40A, 40B (FIG. 4).

Figure 6:
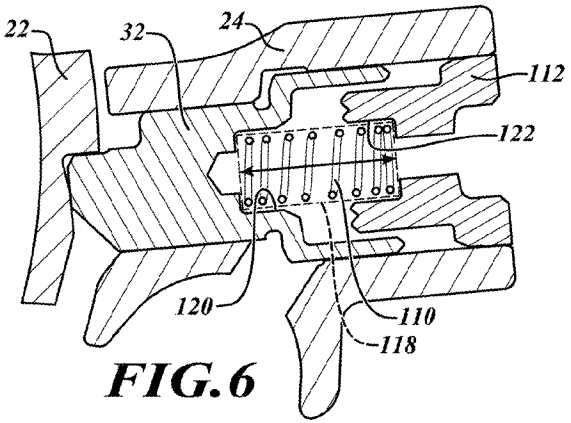
FIG. 6 is a cross-sectional view of the switching rocker arm taken along lines 6-6 of FIG. 4 and showing a latch pin cross-section according to one example.
Figure 7:
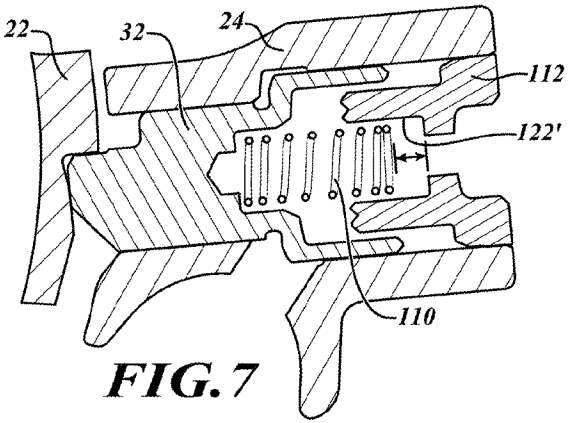
FIG. 7 is a cross-sectional view of the switching rocker arm of FIG. 6 and showing a latch pin cross-section according to a second example.
Figure 8:
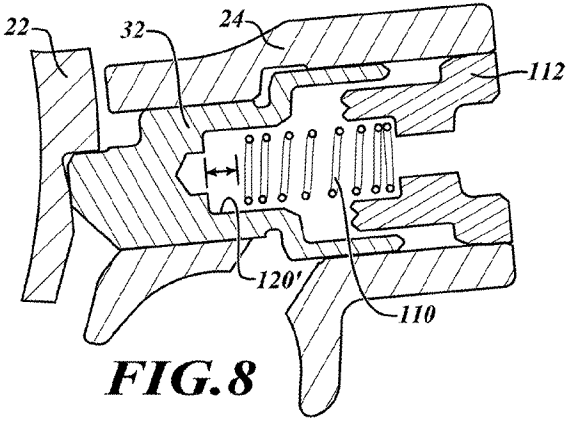
FIG. 8 is a cross-sectional view of the switching rocker arm of FIG. 6 and showing a latch pin cross-section according to a third example.

Turning now to FIGS. 6-8, additional features of the latch 32 will be described. As identified above, when the latch 32 is engaged to the inner arm 22 (as shown in FIGS. 6 and 7), the inner arm 22 and the outer arm 24 operate together like a standard rocker arm to open the engine valve 26. In the no-lift (unlatched) position, the inner arm 22 and the outer arm 24 can move independently to enable cylinder deactivation. A latch spring 110 is disposed between the latch 32 and a latch retainer 112. Specifically a collective pocket 118 is defined between a first recess 120 in the latch 32 and a second recess 122 in the latch retainer 112. The example shown in FIG. 7 shows a deepened second recess 122' that may be incorporated to yield a longer spring and spring pocket. In the example shown, the second recess 122' can be deepened by 1.2 mm. Alternatively, the example shown in FIG. 8 shows a deepened first recess 120' that may be incorporated to yield a longer spring and spring pocket. In the example shown, the first recess 120' can be deepened by 1.2 mm. It will be appreciated that other dimensions and/or combinations of dimensions for the first and second recesses 120, 122 may be incorporated to accommodate longer spring lengths such a spring 110 having a length of 8.2 mm.

Figure 9:
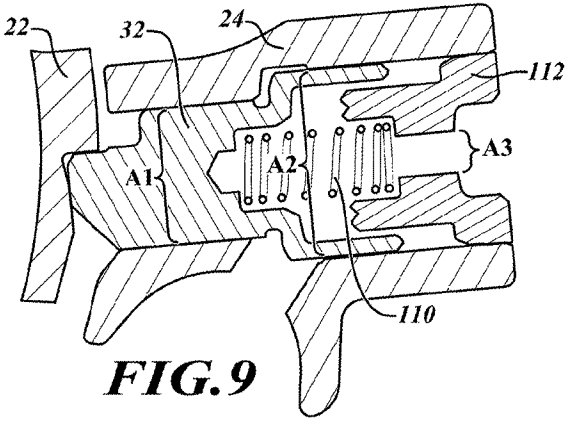
FIG. 9 is a cross-sectional view of the switching rocker arm of FIG. 6 and showing a latch pin cross-section according to a fourth example.

Turning now to FIG. 9, additional features of the present disclosure related to resistive forces acting on the latch pin 32 upon pressurization will be described. The force of the spring 110 is not velocity dependent. In one configuration, the latch 32 can have an area A1 of 27.7 $mm^2$ and an area A2 of 51.9 $mm^2$. The latch retainer 112 can define an area A3 of 2.54 $mm^2$. As can be appreciated, resistive force will slow the motion of the latch 32. In one configuration the oil exit path can be enlarged.

Figure 10:
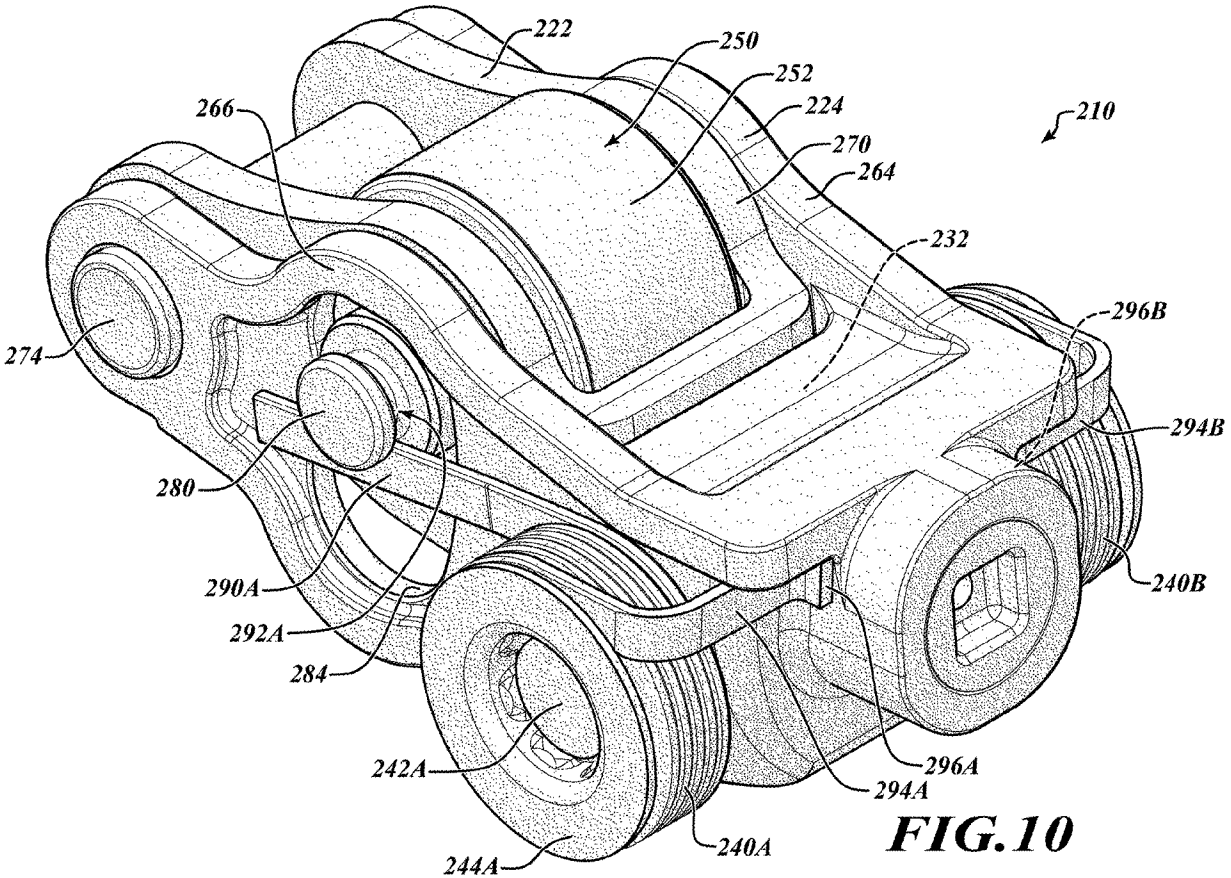
FIG. 10 is a top perspective view of a switching rocker arm constructed in accordance to additional features of the present disclosure.
Figure 11:
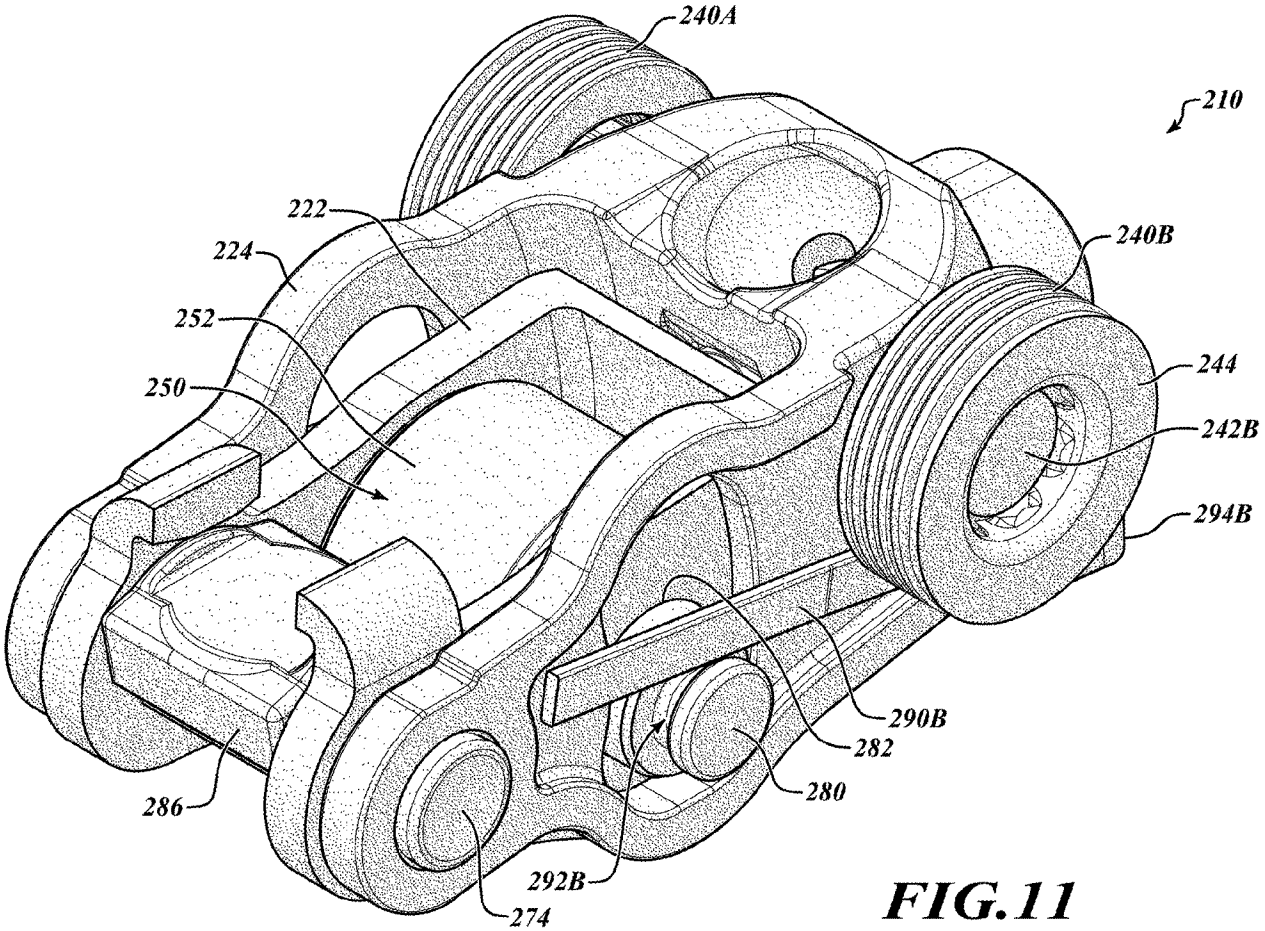
FIG. 11 is a bottom perspective view of the switching rocker arm of FIG. 10.

With reference now to FIGS. 10 and 11, a switching rocker arm assembly constructed in accordance to another example of the present disclosure is shown and generally identified at reference numeral 210. The switching rocker arm assembly 210 can include an inner arm 222, an outer arm 224. The default configuration is in the normal-lift (latched) position where the inner arm 222 and the outer arm 224 are locked together, causing an engine valve 26 (FIG. 1) to open and allowing the cylinder to operate as it would in a standard valvetrain. When a latch 232 is engaged (such as when the upper oil port 30 is pressurized as described above), the inner arm 222 and the outer arm 224 operate together like a standard rocker arm to open the engine valve 26 (FIG. 1). In the no-lift (unlatched) position, the inner arm 222 and the outer arm 224 can move independently to enable cylinder deactivation.

A pair of lost motion torsion springs 240A and 240B are incorporated to bias the position of the inner arm 222 so that it always maintains continuous contact with the camshaft lobe 20. The torsion springs 240A and 240B are secured to torsional spring mounts 242A and 242B, respectively located on the outer arm 224 by spring retainers 244A, 244B. The spring retainers 244A, 244B retain the torsion springs 240A, 240B laterally. The lost motion torsion springs 240A, 240B require a higher preload than designs that use multiple lobes to facilitate continuous contact between the camshaft lobe 20 and an inner arm bearing 250 having a roller follower 252.

The outer arm 224 can have a first outer side arm 264 and a second outer side arm 266. The inner arm 222 can be disposed between the first outer side arm 264 and the second outer side arm 266. The inner arm 222 can have a first inner side arm 270 and a second inner side arm 272. The inner arm 222 and the outer arm 224 are both mounted to a pivot axle 274. The pivot axle 274 can be located adjacent to a first end of the rocker arm assembly 210, which secures the inner arm 222 to the outer arm 224 while also allowing a rotational degree of freedom pivoting about the pivot axle 274 when the rocker arm assembly 210 is in a deactivated state.

The bearing 250 and roller follower 252 are mounted between the first inner side arm 270 and the second inner side arm 272 on a bearing axle 280 that, during normal operation of the rocker arm assembly 210 serves to transfer energy from the rotating cam 20 to the rocker arm assembly 210. The bearing axle 280 is biased upwardly by the bearing axle springs 240A, 240B. Mechanical lash can be set mechanically with a valve tip cap (not specifically shown). It will be appreciated that a plurality of valve tip caps may be provided having different geometries. A suitable valve tip cap can be assembled between an elephant foot (e-foot) 286 (FIG. 11) and the engine valve 26 to take up the variance on the rocker arm assembly 210 between the engine valve 26, the cam 20 and the DFHLA 12. The bearing axle 280 is mounted to the inner arm 222 in bearing axle apertures 282 defined in the inner arm 222. The bearing axle 280 extends through bearing axle slots 284 defined in the outer arm 224.

The rocker arm assembly 210 incorporates a torsion spring configuration that is particularly favorable for packaging constraints seen in some engine configurations. In this regard, both of the torsion springs 240A, 240B have a first or inboard end 290A, 290B that engages the bearing axle 280 at a bearing axle groove 292A, 292B. Both of the torsion springs 240A, 240B also have a second or outboard end 294A, 294B that engages the outer arm 24. The second ends 294A, 294B bend toward the outer arm 24 in a direction generally transverse to the first ends 290A, 290B. A terminal lip 296A, 296B extends in a direction generally parallel to the first ends 290A, 290B.

Figure 12:
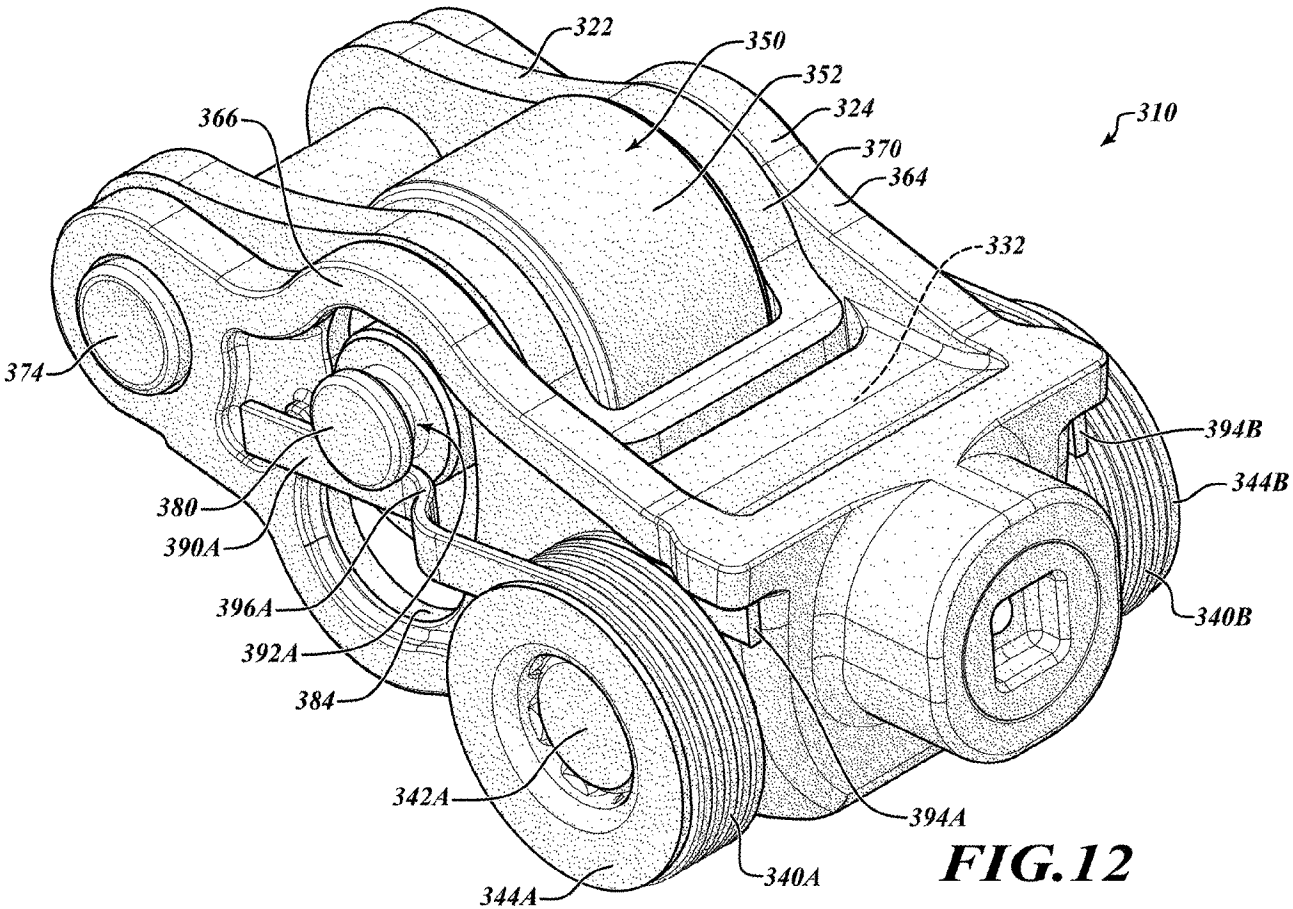
FIG. 12 is a top perspective view of a switching rocker arm constructed in accordance to additional features of the present disclosure.
Figure 13:
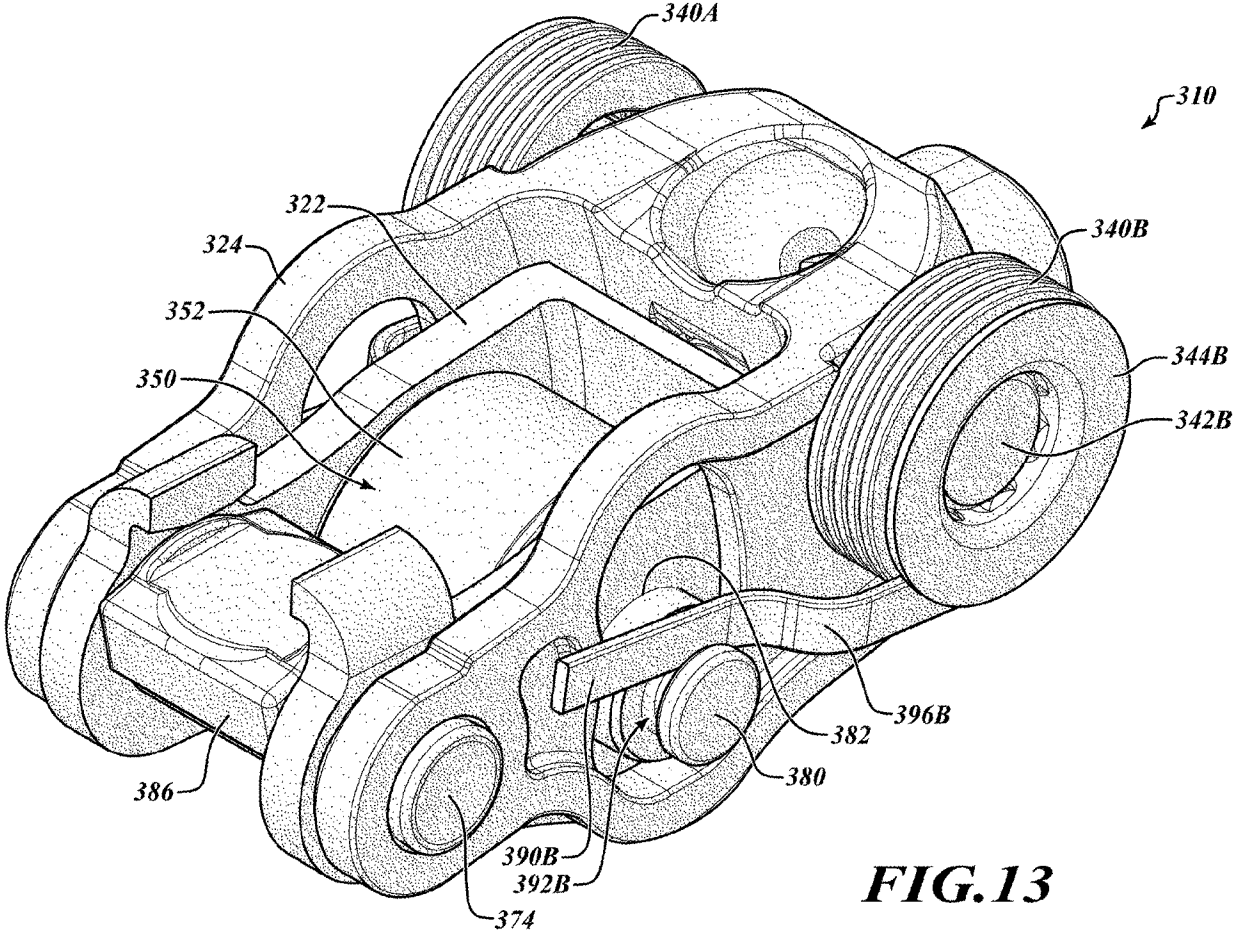
FIG. 13 is a bottom perspective view of the switching rocker arm of FIG. 12.

With reference now to FIGS. 12 and 13, a switching rocker arm assembly constructed in accordance to another example of the present disclosure is shown and generally identified at reference numeral 310. The switching rocker arm assembly 310 can include an inner arm 322, an outer arm 324. The default configuration is in the normal-lift (latched) position where the inner arm 322 and the outer arm 324 are locked together, causing an engine valve 26 (FIG. 1) to open and allowing the cylinder to operate as it would in a standard valvetrain. When a latch 332 is engaged (such as when the upper oil port 30 is pressurized as described above), the inner arm 322 and the outer arm 324 operate together like a standard rocker arm to open the engine valve 26 (FIG. 1). In the no-lift (unlatched) position, the inner arm 322 and the outer arm 324 can move independently to enable cylinder deactivation.

A pair of lost motion torsion springs 340A and 340B are incorporated to bias the position of the inner arm 322 so that it always maintains continuous contact with the camshaft lobe 20. The torsion springs 340A and 340B are secured to torsional spring mounts 342A and 342B, respectively located on the outer arm 324 by spring retainers 344A, 344B. The spring retainers 344A, 344B retain the torsion springs 340A, 340B laterally. The lost motion torsion springs 340A, 340B require a higher preload than designs that use multiple lobes to facilitate continuous contact between the camshaft lobe 20 and an inner arm bearing 350 having a roller follower 352.

The outer arm 324 can have a first outer side arm 364 and a second outer side arm 366. The inner arm 322 can be disposed between the first outer side arm 364 and the second outer side arm 366. The inner arm 322 can have a first inner side arm 370 and a second inner side arm 372. The inner arm 322 and the outer arm 324 are both mounted to a pivot axle 374. The pivot axle 374 can be located adjacent to a first end of the rocker arm assembly 310, which secures the inner arm 322 to the outer arm 324 while also allowing a rotational degree of freedom pivoting about the pivot axle 374 when the rocker arm assembly 310 is in a deactivated state.

The bearing 350 and roller follower 352 are mounted between the first inner side arm 370 and the second inner side arm 372 on a bearing axle 380 that, during normal operation of the rocker arm assembly 310 serves to transfer energy from the rotating cam 20 to the rocker arm assembly 310. The bearing axle 380 is biased upwardly by the bearing axle springs 340A, 340B. Mechanical lash can be set mechanically with a valve tip cap (not specifically shown). It will be appreciated that a plurality of valve tip caps may be provided having different geometries. A suitable valve tip cap can be assembled between an elephant foot (e-foot) 386 (FIG. 13) and the engine valve 26 to take up the variance on the rocker arm assembly 310 between the engine valve 26, the cam 20 and the DFHLA 12. The bearing axle 380 is mounted to the inner arm 322 in bearing axle apertures 382 defined in the inner arm 322. The bearing axle 380 extends through bearing axle slots 384 defined in the outer arm 324.

The rocker arm assembly 310 incorporates a torsion spring configuration that is particularly favorable for packaging constraints seen in some engine configurations. In this regard, both of the torsion springs 340A, 340B have a first or outboard end 390A, 390B that engages the bearing axle 380 at a bearing axle groove 392A, 392B. Both of the torsion springs 340A, 340B also have a second or inboard end 394A, 394B that engages the outer arm 324. The first ends 390A, 390B have an intermediate bend 396A, 396B toward the bearing axle 380.

Figure 14:
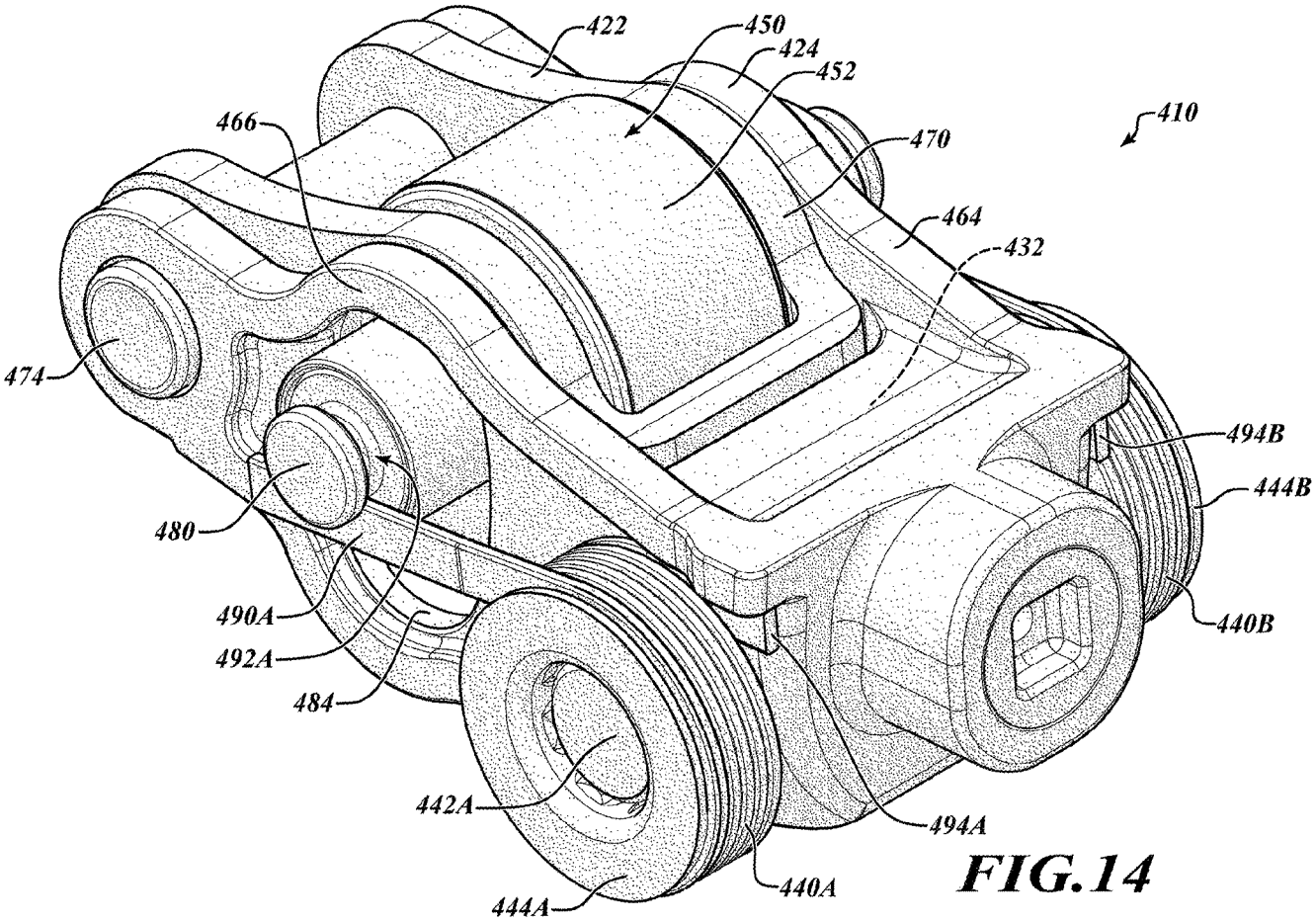
FIG. 14 is a top perspective view of a switching rocker arm constructed in accordance to additional features of the present disclosure.
Figure 15:
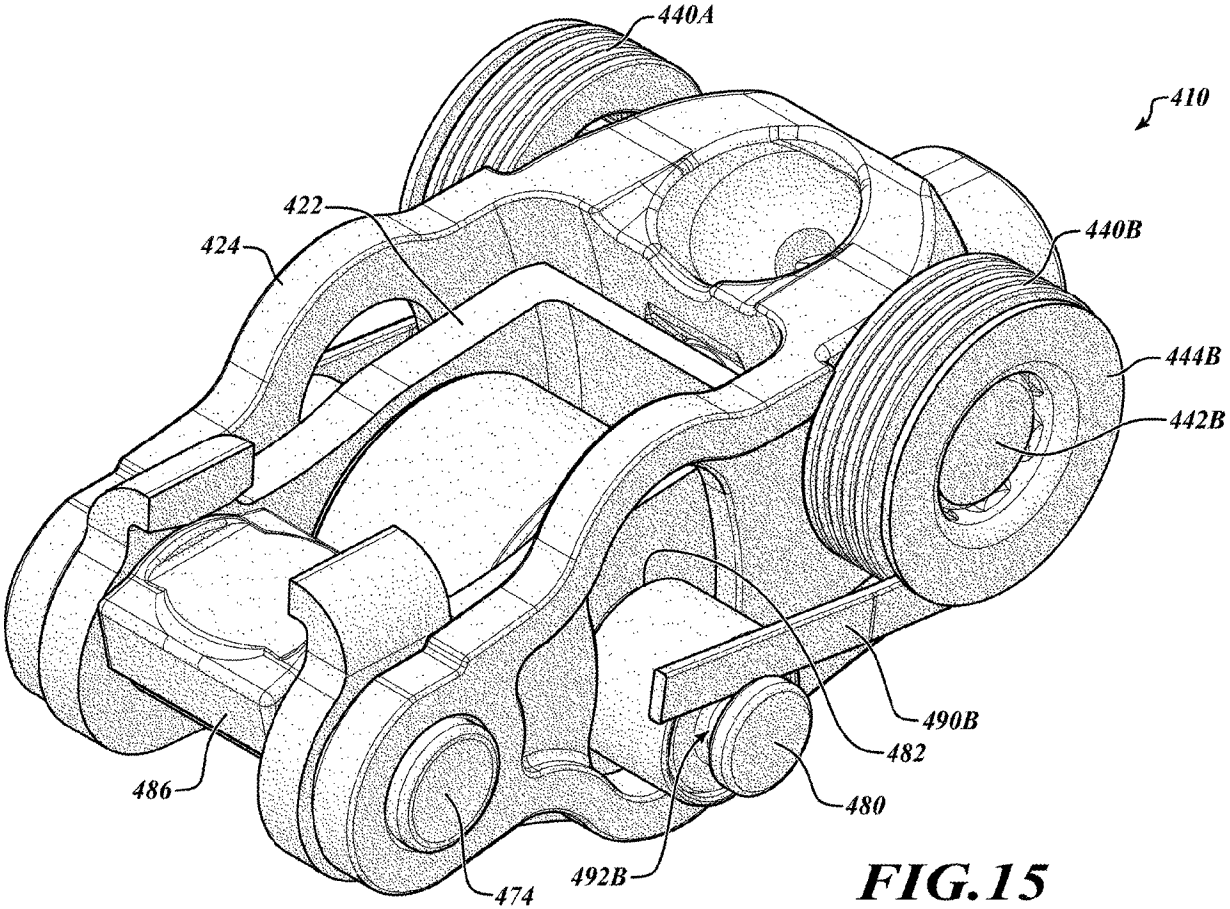
FIG. 15 is a bottom perspective view of the switching rocker arm of FIG. 14.

With reference now to FIGS. 14 and 15, a switching rocker arm assembly constructed in accordance to another example of the present disclosure is shown and generally identified at reference numeral 410. The switching rocker arm assembly 410 can include an inner arm 422, an outer arm 424. The default configuration is in the normal-lift (latched) position where the inner arm 422 and the outer arm 424 are locked together, causing an engine valve 26 (FIG. 1) to open and allowing the cylinder to operate as it would in a standard valvetrain. When a latch 432 is engaged (such as when the upper oil port 30 is pressurized as described above), the inner arm 422 and the outer arm 424 operate together like a standard rocker arm to open the engine valve 26 (FIG. 1). In the no-lift (unlatched) position, the inner arm 422 and the outer arm 424 can move independently to enable cylinder deactivation.

A pair of lost motion torsion springs 440A and 440B are incorporated to bias the position of the inner arm 422 so that it always maintains continuous contact with the camshaft lobe 20. The torsion springs 440A and 440B are secured to torsional spring mounts 442A and 442B, respectively located on the outer arm 424 by spring retainers 444A, 444B. The spring retainers 444A, 444B retain the torsion springs 440A, 440B laterally. The lost motion torsion springs 440A, 440B require a higher preload than designs that use multiple lobes to facilitate continuous contact between the camshaft lobe 20 and an inner arm bearing 450 having a roller follower 452.

The outer arm 424 can have a first outer side arm 464 and a second outer side arm 466. The inner arm 422 can be disposed between the first outer side arm 464 and the second outer side arm 466. The inner arm 422 can have a first inner side arm 470 and a second inner side arm 472. The inner arm 422 and the outer arm 424 are both mounted to a pivot axle 474. The pivot axle 474 can be located adjacent to a first end of the rocker arm assembly 410, which secures the inner arm 422 to the outer arm 424 while also allowing a rotational degree of freedom pivoting about the pivot axle 474 when the rocker arm assembly 410 is in a deactivated state.

The bearing 450 and roller follower 452 are mounted between the first inner side arm 470 and the second inner side arm 472 on a bearing axle 480 that, during normal operation of the rocker arm assembly 410 serves to transfer energy from the rotating cam 20 to the rocker arm assembly 410. The bearing axle 480 is biased upwardly by the bearing axle springs 440A, 440B. Mechanical lash can be set mechanically with a valve tip cap (not specifically shown). It will be appreciated that a plurality of valve tip caps may be provided having different geometries. A suitable valve tip cap can be assembled between an elephant foot (e-foot) 486 (FIG. 15) and the engine valve 26 to take up the variance on the rocker arm assembly 410 between the engine valve 26, the cam 20 and the DFHLA 12. The bearing axle 480 is mounted to the inner arm 422 in bearing axle apertures 482 defined in the inner arm 422. The bearing axle 480 extends through bearing axle slots 484 defined in the outer arm 424.

The rocker arm assembly 410 incorporates a torsion spring configuration that is particularly favorable for packaging constraints seen in some engine configurations. In this regard, both of the torsion springs 440A, 440B have a first or outboard end 490A, 490B that engages the bearing axle 480 at a bearing axle groove 492A, 492B. Both of the torsion springs 440A, 440B also have a second or inboard end 494A, 494B that engages the outer arm 424.

Figure 16:
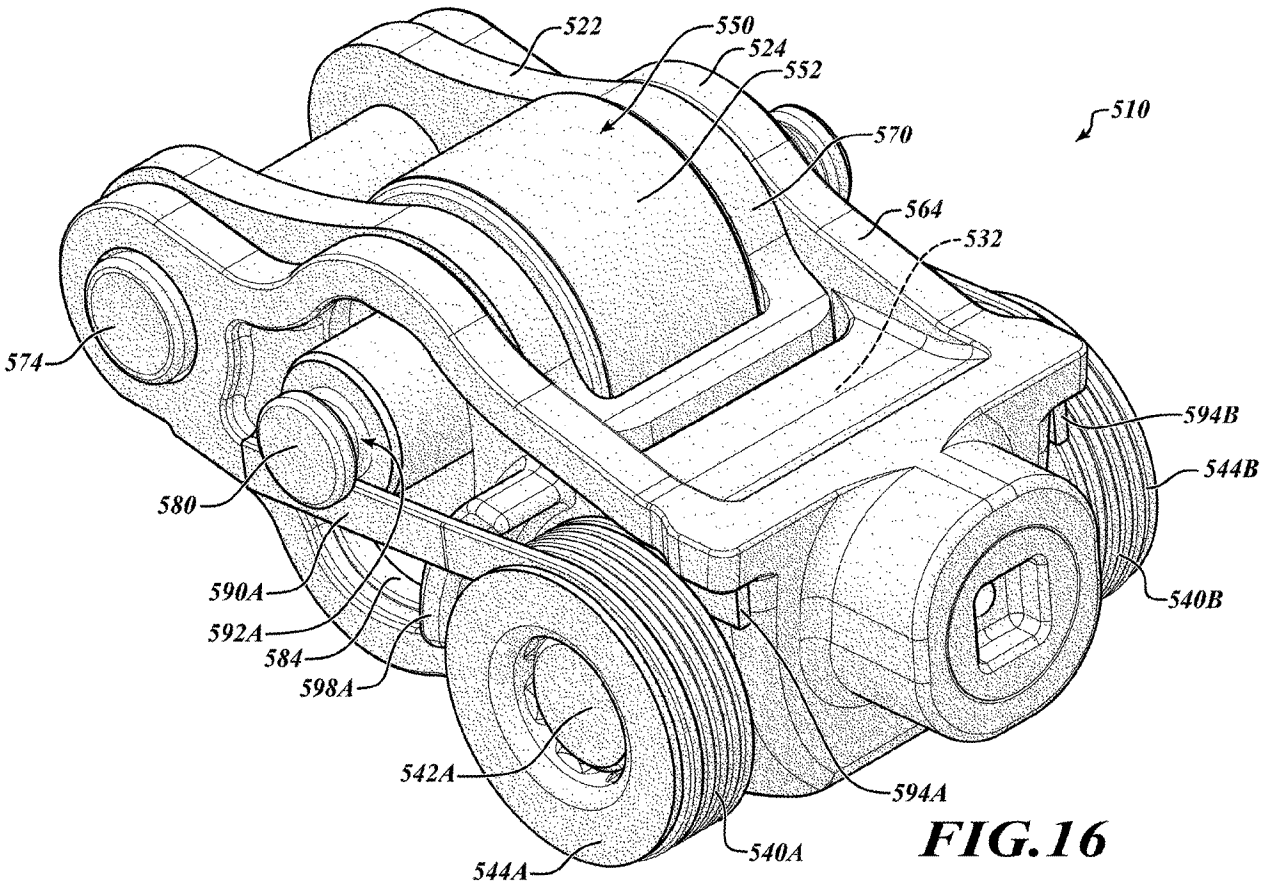
FIG. 16 is a top perspective view of a switching rocker arm constructed in accordance to additional features of the present disclosure.
Figure 17:
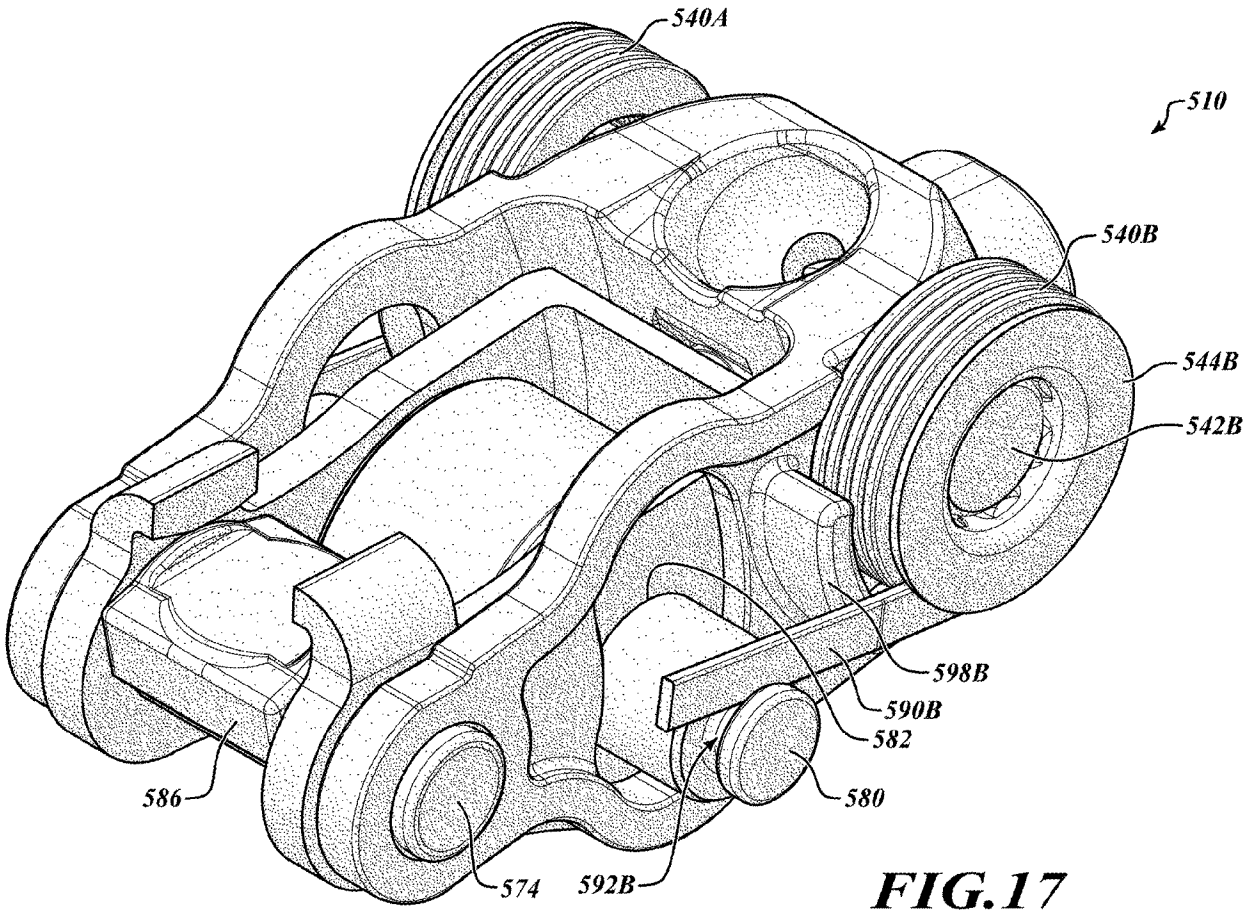
FIG. 17 is a bottom perspective view of the switching rocker arm of FIG. 16.

With reference now to FIGS. 16 and 17, a switching rocker arm assembly constructed in accordance to another example of the present disclosure is shown and generally identified at reference numeral 510. The switching rocker arm assembly 510 can include an inner arm 522, an outer arm 524. The default configuration is in the normal-lift (latched) position where the inner arm 522 and the outer arm 524 are locked together, causing an engine valve 26 (FIG. 1) to open and allowing the cylinder to operate as it would in a standard valvetrain. When a latch 532 is engaged (such as when the upper oil port 30 is pressurized as described above), the inner arm 522 and the outer arm 524 operate together like a standard rocker arm to open the engine valve 26 (FIG. 1). In the no-lift (unlatched) position, the inner arm 522 and the outer arm 524 can move independently to enable cylinder deactivation.

A pair of lost motion torsion springs 540A and 540B are incorporated to bias the position of the inner arm 522 so that it always maintains continuous contact with the camshaft lobe 20. The torsion springs 540A and 540B are secured to torsional spring mounts 542A and 542B, respectively located on the outer arm 524 by spring retainers 544A, 544B. The spring retainers 544A, 544B retain the torsion springs 540A, 540B laterally. The lost motion torsion springs 540A, 540B require a higher preload than designs that use multiple lobes to facilitate continuous contact between the camshaft lobe 20 and an inner arm bearing 550 having a roller follower 552.

The outer arm 524 can have a first outer side arm 564 and a second outer side arm 566. The inner arm 522 can be disposed between the first outer side arm 564 and the second outer side arm 566. The inner arm 522 can have a first inner side arm 570 and a second inner side arm 572. The inner arm 522 and the outer arm 524 are both mounted to a pivot axle 574. The pivot axle 574 can be located adjacent to a first end of the rocker arm assembly 510, which secures the inner arm 522 to the outer arm 524 while also allowing a rotational degree of freedom pivoting about the pivot axle 574 when the rocker arm assembly 510 is in a deactivated state.

The bearing 550 and roller follower 552 are mounted between the first inner side arm 570 and the second inner side arm 572 on a bearing axle 580 that, during normal operation of the rocker arm assembly 510 serves to transfer energy from the rotating cam 20 to the rocker arm assembly 510. The bearing axle 580 is biased upwardly by the bearing axle springs 540A, 540B. Mechanical lash can be set mechanically with a valve tip cap (not specifically shown). It will be appreciated that a plurality of valve tip caps may be provided having different geometries. A suitable valve tip cap can be assembled between an elephant foot (e-foot) 586 (FIG. 17) and the engine valve 26 to take up the variance on the rocker arm assembly 510 between the engine valve 26, the cam 20 and the DFHLA 12. The bearing axle 580 is mounted to the inner arm 522 in bearing axle apertures 582 defined in the inner arm 522. The bearing axle 580 extends through bearing axle slots 584 defined in the outer arm 524.

The rocker arm assembly 510 incorporates a torsion spring configuration that is particularly favorable for packaging constraints seen in some engine configurations. In this regard, both of the torsion springs 540A, 540B have a first or outboard end 590A, 590B that engages the bearing axle 580 at a bearing axle groove 592A, 592B. Both of the torsion springs 540A, 540B also have a second or inboard end 594A, 594B that engages the outer arm 524. An intermediate spring support 598A, 598B can extend from the outer arm 524.

A cylinder deactivation rocker arm constructed in accordance to additional features will be described. As identified above, it may be desirable to provide cylinder deactivation capability where packaging constraints are of concern. An engine valvetrain package width on a rocker arm with cylinder deactivation functionality can require modifications such as cam location, base circle of the cam, valve height and valve spring location. Other factors can further constrain packaging. In one example of the present disclosure the inner arm roller of the rocker arm with cylinder deactivation functionality with a slider pad. While slider pads can have increased friction, the packaging benefits of a slider pad may provide sufficient benefits relative to a configuration with a roller, especially where the cam location, cam base circle, valve height, valve spring and combinations thereof cannot be altered. The inner slider arm can be configured such that it yields more clearance in the rocker arm having the lost motion structure and functionality relative to a standard inner arm with a roller. In one example, the packaging advantage can be shown to result in elimination of the roller bearing. The roller bearing can be around 16 mm in diameter, but the integrated slider pad can be shown to yield a relatively slimmer and narrower package.

The foregoing description of the examples has been provided for purposes of illustration and description. It is not intended to be exhaustive or to limit the disclosure. Individual elements or features of a particular example are generally not limited to that particular example, but, where applicable, are interchangeable and can be used in a selected example, even if not specifically shown or described. The same may also be varied in many ways. Such variations are not to be regarded as a departure from the disclosure, and all such modifications are intended to be included within the scope of the disclosure.

What is claimed is:

1. A switching rocker arm assembly comprising:

an outer arm having a first outer side arm and a second outer side arm, the outer arm further including first and second torsional spring mounts, each of the first and second outer side arms defining an underside surface;

an inner arm disposed between the first and second outer side arms;

a pivot axle that supports the inner and outer arms for relative pivotal movement therearound;

a bearing axle that supports a bearing;

a first torsional bearing axle spring mounted around the first torsional spring mount and having a first end engaged to the bearing axle and a second end engaged to the underside surface of the first outer side arm, wherein the first end extends outboard relative to the second end; and a second torsional bearing axle spring mounted around the second torsional spring mount and having a first end engaged to the bearing axle and a second end engaged to the underside surface of the second outer side arm, wherein the first end of the second torsional bearing axle spring extends outboard relative to the second end of the second torsional bearing spring, wherein the second end of the first torsional bearing axle spring engages a first tang extending from the outer arm, and wherein the second end of the second torsional bearing axle spring engages a second tang extending from the outer arm, the first and second tangs at least partially defining the underside surface.

2. The switching rocker arm of claim 1, further comprising a roller follower mounted between the first inner side arm and the second inner side arm on the bearing axle.

3. The switching rocker arm assembly of claim 1 wherein the first end of the first torsional bearing axle spring is nestingly received in a first groove formed in the bearing axle, and wherein the first end of the second torsional bearing axle spring is nestingly received in a second groove formed in the bearing axle.

4. The switching rocker arm assembly of claim 1, further comprising an elephant foot (e-foot), wherein the e-foot is assembled between a central axle body of the pivot axle and a valve, wherein rotation of the pivot axle causes the e-foot to move relative to the valve.

5. The switching rocker arm assembly of claim 1, further comprising a latch that selectively secures the inner arm relative to the outer arm thereby selectively permitting lost motion movement of the inner arm relative to the outer arm about the pivot axle.

6. The switching rocker arm assembly of claim 5, further comprising a latch spring disposed within a collective pocket defined between (i) a first recess in the latch and (ii) a second recess in a latch retainer, wherein the collective pocket supports a latch spring having a length of 8.2 mm.

7. The switching rocker arm assembly of claim 1 wherein the first torsional bearing axle spring further includes an intermediate bend toward the bearing axle.

8. The switching rocker arm assembly of claim 7 wherein the second torsional bearing axle spring further includes an intermediate bend toward the bearing axle.

9. The switching rocker arm assembly of claim 7, wherein the intermediate bend is S-shaped.

10. The switching rocker arm assembly of claim 1 wherein the first ends of each of the first and second torsional bearing axle springs extend in a direction opposite of the second ends of the first and second torsional bearing axle springs.

11. The switching rocker arm assembly of claim 1, wherein the first end of the first torsional bearing axle spring extends in a first direction, and the second end of the first torsional bearing axle spring extends in a second direction that is 180° from the first direction.

12. A switching rocker arm assembly comprising:

an outer arm having a first outer side arm and a second outer side arm, the outer arm further including first and second torsional spring mounts, each of the first and second outer side arms defining an underside surface that is opposite a top surface of the outer arm and faces toward a bottom of the outer arm;

an inner arm disposed between the first and second outer side arms;

a pivot axle that supports the inner and outer arms for relative pivotal movement therearound;

a bearing axle that supports a bearing;

a first torsional bearing axle spring mounted around the first torsional spring mount and having a first end engaged to the bearing axle and a second end engaged to the underside surface of the first outer side arm, wherein the first end extends outboard relative to the second end and has an intermediate bend toward the bearing axle; and a second torsional bearing axle spring mounted around the second torsional spring mount and having a first end engaged to the bearing axle and a second end engaged to the underside surface of the second outer side arm, wherein the first end of the second torsional bearing axle spring extends outboard relative to the second end and has an intermediate bend toward the bearing axle;

wherein the underside surface of the first and second outer side arms inhibits rotation of the second ends of the respective first and second bearing axle springs in a direction toward the outer arm top surface and away from the first and second torsional spring mounts, wherein the second end of the first torsional bearing axle spring engages a first tang extending from the outer arm, and wherein the second end of the second torsional bearing axle spring engages a second tang extending from the outer arm, the first and second tangs at least partially defining the underside surface.

13. The switching rocker arm of claim 12, further comprising a roller follower mounted between the first inner side arm and the second inner side arm on the bearing axle.

14. The switching rocker arm assembly of claim 12 wherein the first end of the first torsional bearing axle spring is nestingly received in a first groove formed in the bearing axle, and wherein the first end of the second torsional bearing axle spring is nestingly received in a second groove formed in the bearing axle.

15. The switching rocker arm assembly of claim 12, further comprising an elephant foot (e-foot), wherein the e-foot is assembled between a central axle body of the pivot axle and a valve, wherein rotation of the pivot axle causes the e-foot to move relative to the valve.

16. The switching rocker arm assembly of claim 12, further comprising a latch that selectively secures the inner arm relative to the outer arm thereby selectively permitting lost motion movement of the inner arm relative to the outer arm about the pivot axle.

17. The switching rocker arm assembly of claim 12, wherein the intermediate bend is S-shaped, and wherein the first ends of each of the first and second torsional bearing axle springs extend in a direction opposite of the second ends of the first and second torsional bearing axle springs.

18. The switching rocker arm assembly of claim 17, wherein the second ends of the first and second torsional bearing axle springs extend in a direction parallel to the first ends of the first and second torsional bearing axle springs.

* * * * *